US006540223B2

(12) United States Patent
Keane et al.

(10) Patent No.: US 6,540,223 B2
(45) **Date of Patent: *Apr. 1, 2003**

(54) ON-EDGE STACKING APPARATUS

(75) Inventors: Joseph J. Keane, Telford, PA (US); Donato C. Farole, Lehighton, PA (US); Glenn A. Nester, Pottstown, PA (US)

(73) Assignee: KFW Automation, Inc., Allentown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/091,196

(22) Filed: Mar. 5, 2002

(65) Prior Publication Data

US 2002/0089115 A1 Jul. 11, 2002

Related U.S. Application Data

(63) Continuation of application No. 09/561,506, filed on Apr. 28, 2000.

(51) Int. Cl.[7] ..... B65H 29/40
(52) U.S. Cl. ..... 271/178
(58) Field of Search ..... 271/2, 178; 414/798.2, 414/798.5, 757; 198/405, 411; 209/900

(56) References Cited

U.S. PATENT DOCUMENTS

| | | | | |
|---|---|---|---|---|
| 582,593 A | * | 5/1897 | Waite | 271/178 |
| 3,342,481 A | * | 9/1967 | Kaplan | 271/178 |
| 4,432,540 A | | 2/1984 | Akers et al. | |
| 4,570,922 A | | 2/1986 | Akers | |
| 4,705,157 A | | 11/1987 | Bowles | |
| 4,718,660 A | * | 1/1988 | Daboub | 271/177 |
| 4,903,955 A | | 2/1990 | Manzke | |
| 4,940,219 A | * | 7/1990 | Volat | 271/2 |

FOREIGN PATENT DOCUMENTS

| | | |
|---|---|---|
| BE | 519942 | 11/1953 |
| DE | 1 289 491 | 2/1969 |
| JP | 6-127784 A2 | 5/1994 |
| WO | WO 93/18996 | 9/1993 |

(List continued on next page.)

*Primary Examiner*—Joseph E. Valenza
*Assistant Examiner*—Mark A. Deuble
(74) *Attorney, Agent, or Firm*—Caesar, Rivise, Bernstein, Cohen & Pokotilow, Ltd.

(57) ABSTRACT

A stacking apparatus for stacking flat articles on edge is provided where each article has a front perimeter edge and two faces and the stacking apparatus receives each flat article as it enters the stacking apparatus moving in a direction generally parallel to the face of each article. The stacking apparatus includes a discharge magazine for sequentially receiving and stacking the flat articles face-to-face in an on-edge stack. The discharge magazine includes an article inlet, a register wall wherein the front perimeter edge of each envelope contacts the register wall to align each front perimeter edge of each article as the articles enter said stack. The discharge magazine further includes an article face support member, wherein a face of one of the flat articles abuts the article face support member, and a segmented roller for receiving and aligning the flat articles for insertion into the on-edge stack. The segmented roller includes a rotatable segmented cylinder having a longitudinal central axis. The segmented cylinder is located adjacent the article inlet and has a planar surface thereon substantially parallel to the longitudinal central axis of the segmented cylinder. The planar surface in the segmented cylinder opens a gap between a prior article and the segmented roller, receives a single article and incrementally rotates to drive the article against a register wall, with the segmented roller continuing to rotate until the planar surface is rotated into position to open an additional gap between the stack and the segmented roller ready to receive the next article entering the article inlet.

4 Claims, 6 Drawing Sheets

U.S. PATENT DOCUMENTS

| | | | | |
|---|---|---|---|---|
| 5,029,832 | A | | 7/1991 | Orsinger et al. |
| 5,129,503 | A | | 7/1992 | Belec et al. |
| 5,201,504 | A | | 4/1993 | Fallos et al. |
| 5,211,384 | A | | 5/1993 | Orsinger et al. |
| 5,217,218 | A | | 6/1993 | Ricciardi |
| 5,221,080 | A | | 6/1993 | Ricciardi |
| 5,368,287 | A | | 11/1994 | Belec |
| 5,372,360 | A | | 12/1994 | Ricciardi |
| 5,411,250 | A | | 5/1995 | Belec et al. |
| 5,429,249 | A | | 7/1995 | Belec et al. |
| 5,485,989 | A | * | 1/1996 | McCay et al. ..... 271/2 |
| 5,709,525 | A | | 1/1998 | Marzullo et al. |
| 5,960,963 | A | | 10/1999 | Chodack et al. |
| 5,971,161 | A | | 10/1999 | Branecky et al. |
| 6,241,460 | B1 | | 6/2001 | Werner |

* cited by examiner 10
20
22
24
24
40
16
42
48
60
82
50
44
18
46
12
100
54
52
14
80

10
20
22
24
24
24
40
16
42
60
82
50
44
46
18
12
100
54
52
14
80

20
40
24
42
48
60
82
50
44
22
12
46
24
24
100
54
10
62
52
14
80

ON-EDGE STACKING APPARATUS

This application is a continuation of Ser. No. 09/561,506 filed Apr. 28,2000.

BACKGROUND OF THE INVENTION

This invention relates generally to mass mail handling equipment. More particularly, this invention relates to an improved apparatus for taking a series of flat articles such as envelopes, orienting them, and then stacking the articles in groupings.

In the high volume mail industry, in both U. S. First Class and Third Class mail, envelopes are filled with various letter pieces using automated mail inserters. For example, U.S. Pat. No. 5,029,832 and U.S. Pat. No. 5,211,384 disclose an in-line inserter device having envelope and feeding assemblies, an envelope inserting station, a sealing and stacking assembly, and various diverter stations.

Mass-mailing equipment has become very diverse in its functions. For instance, inserting equipment transport envelopes along an inserting track while various types of inserts are automatically inserted into the envelopes. The envelopes are normally transported to another piece of equipment that automatically seals the envelopes, weighs them and affixes postage. Still additional equipment automatically reads the zip codes or zip code indicia on the envelopes and indicates zip code breaks in the envelope groups for zip code pre-sorting. This allows the user to take advantage of lower postage rates. Other mass-mailing equipment may include remittance processing equipment and zip code sorting equipment.

Customers utilizing mass-mailing equipment may have differing needs and requirements. Therefore, mass-mailing equipment is generally designed for one specific function. Each piece can then be connected by conveyor or other transport means to additional mail processing equipment so that a customized system can be assembled. One problem with this approach is that adjacent mail processing equipment may require the envelopes to be oriented in a position which is different from the discharge device of the preceding equipment. This necessitates transition conveyors or re-orientation devices.

For example, most mail processing inserting equipment in use today move the envelopes along a track with their faces (the addresses) face down and the flaps extended with the back of the flaps up during the insertion mode. The envelopes, as they leave the inserting machine, may have the flaps moistened and sealed before exiting the inserting machine. If the envelope is then going to have postage applied, it must be turned over 180 degrees so that the postage can be affixed to the face of the envelope. Other operations may require the envelope to be turned 90 degrees.

One such stacking apparatus is disclosed in U.S. Pat. No. 4,705,157. Here, a device is disclosed for turning envelopes 90 degrees as the envelopes are moved forward through the device from an entrance location to an exit location using two endless belts adjacent to one another. The envelopes are ultimately stacked once they leave the exit location.

Currently, many inserters simply eject the filled envelope onto a short flat conveyor, allowing the envelopes to free float on the conveyor. This causes the possibility that the zip order of the envelopes will get mixed up, the possibility of envelopes becoming disorderly and difficult to quickly pick up, and the possibility of envelope flaps popping opened prior to proper glue drying. Additionally, this method is an inefficient use of conveyor space, allowing only a short amount of time before the conveyor becomes full. This requires the increased attention from an operator. Often, an operator is forced to shut down the entire machine so that he or she can catch up with the emptying of the conveyor. Obviously, this drastically reduces the overall throughput of envelopes.

These mail inserters may run at speeds, for example, from several hundred filled envelopes per hour to approximately 18,000 envelopes per hour. These speeds have created a need on the end of the inserters to collect the filled envelopes in such a way as to allow the operator to load them into mail trays or other forms of storage quickly and efficiently. In addition, since these envelopes are often prearranged in special zip code order, this order must be maintained by the operator and then separated into different trays depending on these zip code groupings.

This area has proven to be the "bottleneck" of the mail insertion process. Many times, the operator has a difficult time keeping up with the inserter. Additionally, the envelopes are not presented in such a way that the zip code breaks can be read easily. The operator may develop fatigue, possibly even carpal tunnel syndrome, because of excess handling of envelopes. One means to assist here is the inclusion of an envelope stacking apparatus at the end of the system to secure the sorted mail pieces in a stacked position to facilitate the orderly removal of the processed mail pieces from the system.

One area of difficulty with envelope stacking apparatus is the high likelihood of jamming and high complexity of various apparatus presently available. For example, one method used to handle envelopes after inserting, as provided in U.S. Pat. No. 4,903,955, is a conveyor that turns the envelopes on edge and horizontally stacks them using a wire auger, in the form of an enlarged corkscrew. Shortcomings of this method include the requirement for a complex algorithm to keep an open part of the auger exposed to the incoming envelope in addition to a possible short life of a spring clutch used to turn the auger.

U.S. Pat. No. 4,705,157 provides an article turning apparatus for turning envelopes to an on-edge position and discharging those envelopes for stacking on a conveyor. Two belts receive an envelope in a horizontal position and turn it ninety degrees to an on-edge position. This patent also discloses a segmented roller that assists in stacking the envelopes vertically. However, here, the segmented roller turns continuously and the segmented roller is adapted to strike the surface of the last discharged envelope to create a pulsing force. This system does not prevent the jamming of an incoming envelope.

U.S. Pat. Nos. 5,485,989 and 5,201,504 do handle higher speed inserters and offset the stack at a zip break. However, the conveyors disclosed in these patents are complex and costly and require that the zip break signal be given to it via electronic communication from the inserter.

PCT Serial No. PCT/93/02731 discloses an apparatus for stacking sheet like articles having a discharge magazine that includes conveyor belts and a document stop element for receiving articles on edge. A sensing means indexes the conveyor belts to allow envelopes to be stacked on a magazine.

OBJECTS OF THE INVENTION

Accordingly, it is a general object of the present invention to provide an improved on-edge stacking apparatus for stacking a plurality of flat articles on edge which overcomes the disadvantages of the prior art.

It is a further object of the present invention to provide an improved on-edge stacking apparatus for stacking a plurality of flat articles such as envelopes on edge that operates at high speed.

It is a still further object of the present invention to provide an improved on-edge stacking apparatus for stacking a plurality of flat articles such as envelopes on edge that operates without jamming.

It is yet another object of the present invention to provide an improved on-edge stacking apparatus for stacking a plurality of flat articles such as envelopes on edge that provides a means to separate different groups of the articles.

It is still another object of the present invention to provide an improved on-edge stacking apparatus for stacking a plurality of flat articles such as envelopes on edge that re-orients from a flat position to an upright, on-edge position.

It is a further object of this invention to provide an improved on-edge stacking apparatus for stacking a plurality of flat articles such as envelopes on edge that does not require an operator to shut down the apparatus on a regular basis so that the operator can catch up with the emptying of the stacked articles.

It is a further object of this invention to provide an improved on-edge stacking apparatus for stacking a plurality of flat articles such as envelopes on edge that does not require a complex algorithm to operate causing potential jamming and failure of the apparatus.

It is a further object of this invention to provide an improved on-edge stacking apparatus for stacking a plurality of flat articles such as envelopes on edge that provides a means to offset a horizontal envelope stack to mark zip code changes.

It is a further object of this invention to provide an improved on-edge stacking apparatus for stacking a plurality of flat articles such as envelopes on edge that maintains pressure on the envelopes in the stack to allow time for the flap glue to dry.

It is a further object of this invention to provide an improved on-edge stacking apparatus for stacking a plurality of flat articles such as envelopes on edge where the articles are moved from a flat position to a horizontal position, either clockwise or counterclockwise using a single belt.

Other objects and many attendant features of this invention will become readily appreciated as the same becomes better understood by reference to the following detailed description when considered in connection with the accompanying drawings.

SUMMARY OF THE INVENTION

These and other objects of this invention are achieved by providing an on-edge stacking apparatus for stacking flat articles on edge, each article having a front perimeter edge and two faces. The stacking apparatus receives each flat article as each article enters the stacking apparatus moving in a direction generally parallel to the faces of each the article. The stacking apparatus includes a discharge magazine for sequentially receiving and stacking the flat articles face-to-face in an on-edge stack, and includes an article inlet, an article edge receiving means where each front perimeter edge contacts the article edge receiving means to align each front perimeter edge of each article as the articles enter the stack, and an article face receiving means wherein a face of one of the flat articles abuts the article face receiving means. The stacking apparatus further includes a segmented roller for receiving and aligning the flat articles for insertion into the on-edge stack, which includes a rotatable segmented cylindrical having a longitudinal central axis. The segmented cylinder is located adjacent the article inlet and has a planar surface substantially parallel to its longitudinal central axis. The planar surface on the segmented cylinder opens a gap between a prior article and the segmented roller, receives a single article and incrementally rotates to drive the article against the article edge receiving means. The segmented roller continues to rotate until the planar surface is rotated into position to open an additional gap between the stack and the segmented roller, where the next envelope is received.

DESCRIPTION OF THE DRAWINGS

Other objects and many attendant features of this invention will become readily appreciated as the same becomes better understood by reference to the following detailed description when considered in connection with the accompanying drawings, wherein.

DETAILED DESCRIPTION OF THE PREFERRED EMBODIMENT

Figure 1:
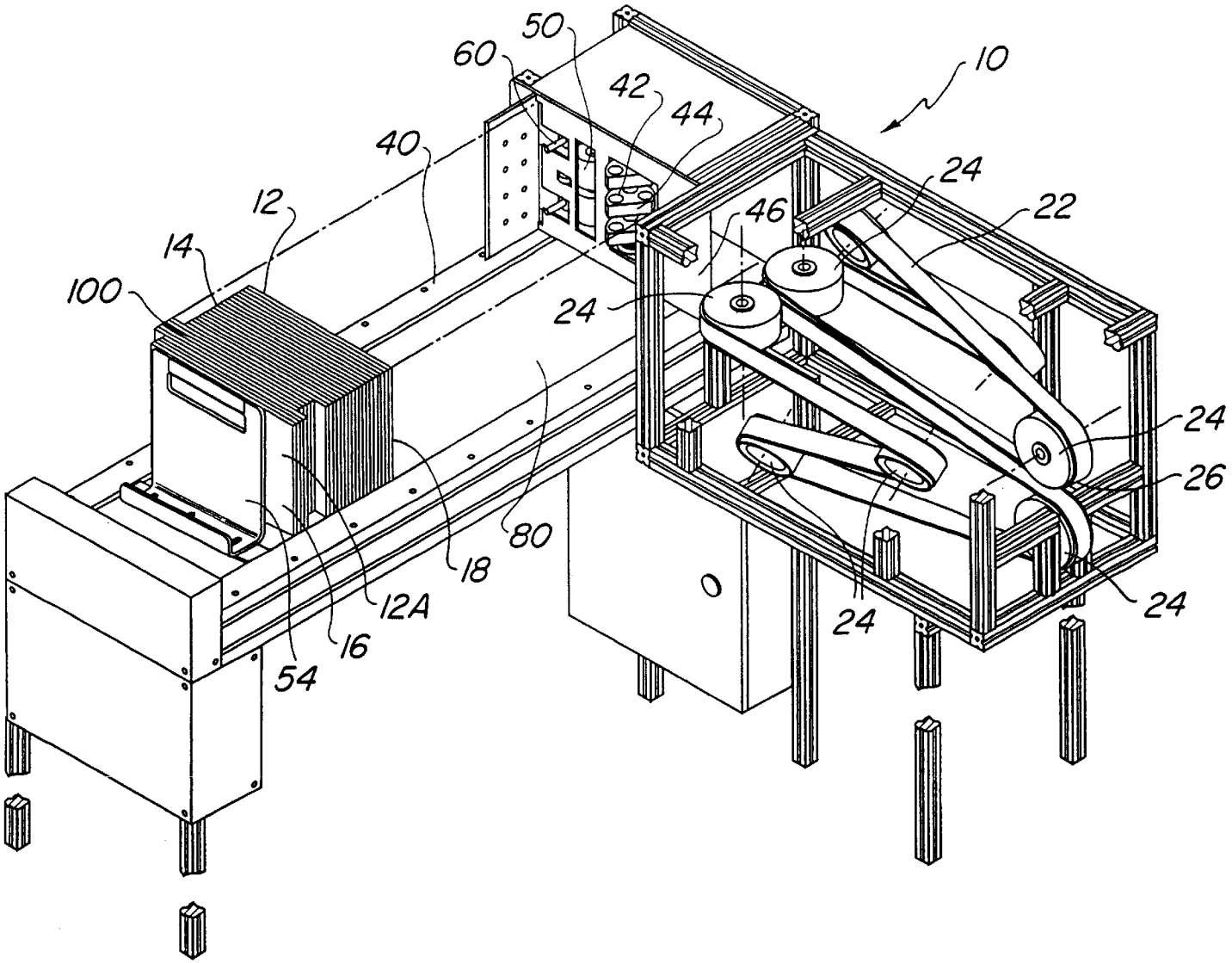
FIG. 1 is an isometric view of an on-edge stacking apparatus in accordance with one preferred embodiment of the present invention.

Referring now to the various figures of the drawing wherein like reference numbers refer to like parts throughout the several views, there is shown in FIG. 1 an on-edge stacking apparatus 10, for stacking articles such as envelopes, in accordance with one preferred embodiment of the present invention. The on-edge stacking apparatus comprises several major components: a belt turn-up mechanism 20, a discharge magazine 40, an article stack offsetting means 60, and an article stack conveyor 80. Each of these components may operate individually, or in combination with the other components of the system. Each is discussed in detail below.

Figure 2:
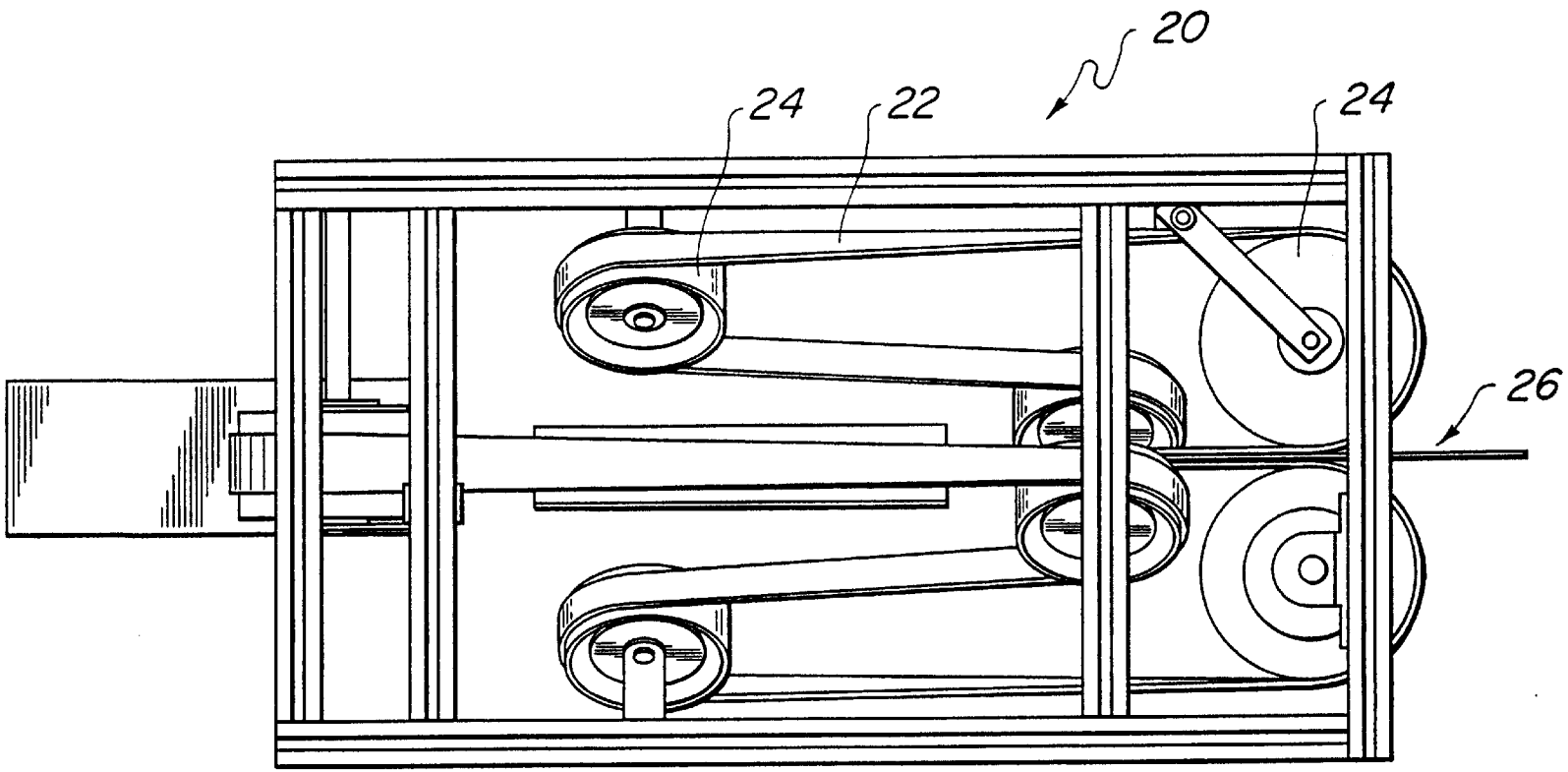
FIG. 2 is a top view of a belt turn-up mechanism as used in the on-edge stacking apparatus of FIG. 1.

As can be seen in FIGS. 1 and 2, the on-edge stacking apparatus 10 of the present invention uses a belt turn-up mechanism 20 to turn a generally flat article such as an envelope 12 from flat to on-edge. The unique design of the belt turn-up apparatus allows use of a single belt 22. This belt turn-up mechanism 20 can be set up to either turn the envelope 12 clockwise or counterclockwise simply by re-threading the belt over existing pulleys 24 in the system. The entrance 26 to the belt turn-up apparatus 20 offers an area to mount an electronic reading device that can detect a zip code break mark on the incoming envelope.

Figure 3:
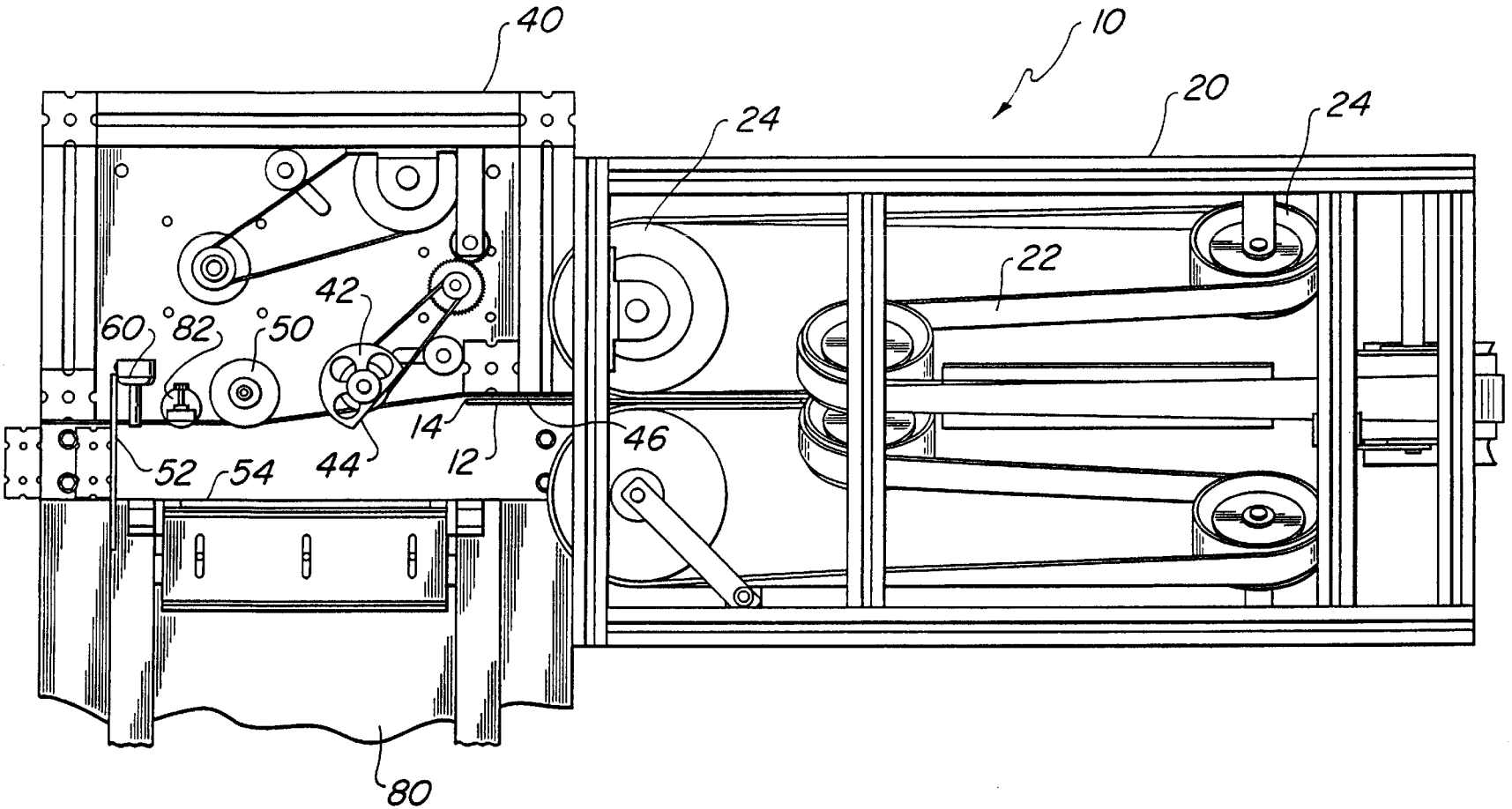
FIG. 3 is a partial top view of the on-edge stacking apparatus of FIG. 1 depicted without an envelope stack.
Figure 4:
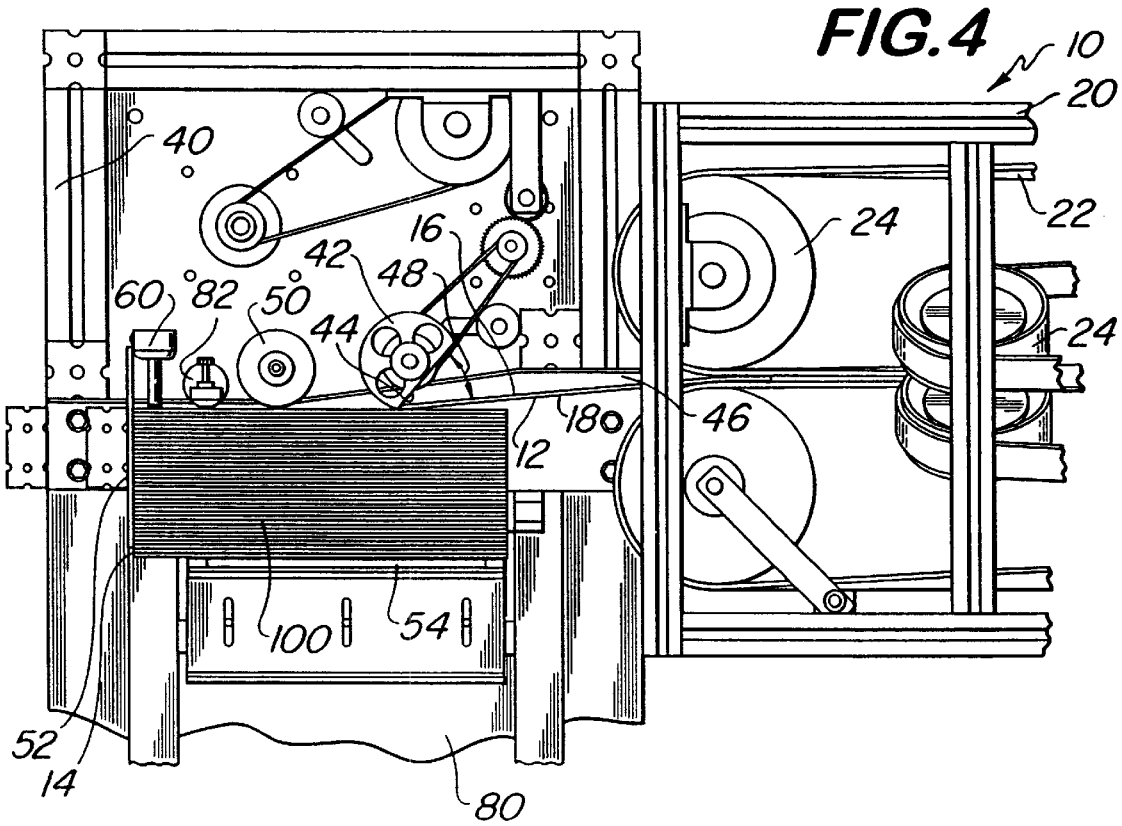
FIG. 4 is a partial top view of the on-edge stacking apparatus of FIG. 1. depicted with an envelope stack and a single envelope entering the envelope stack with a segmented roller in its home position and an envelope engaging the segmented roller.
Figure 5:
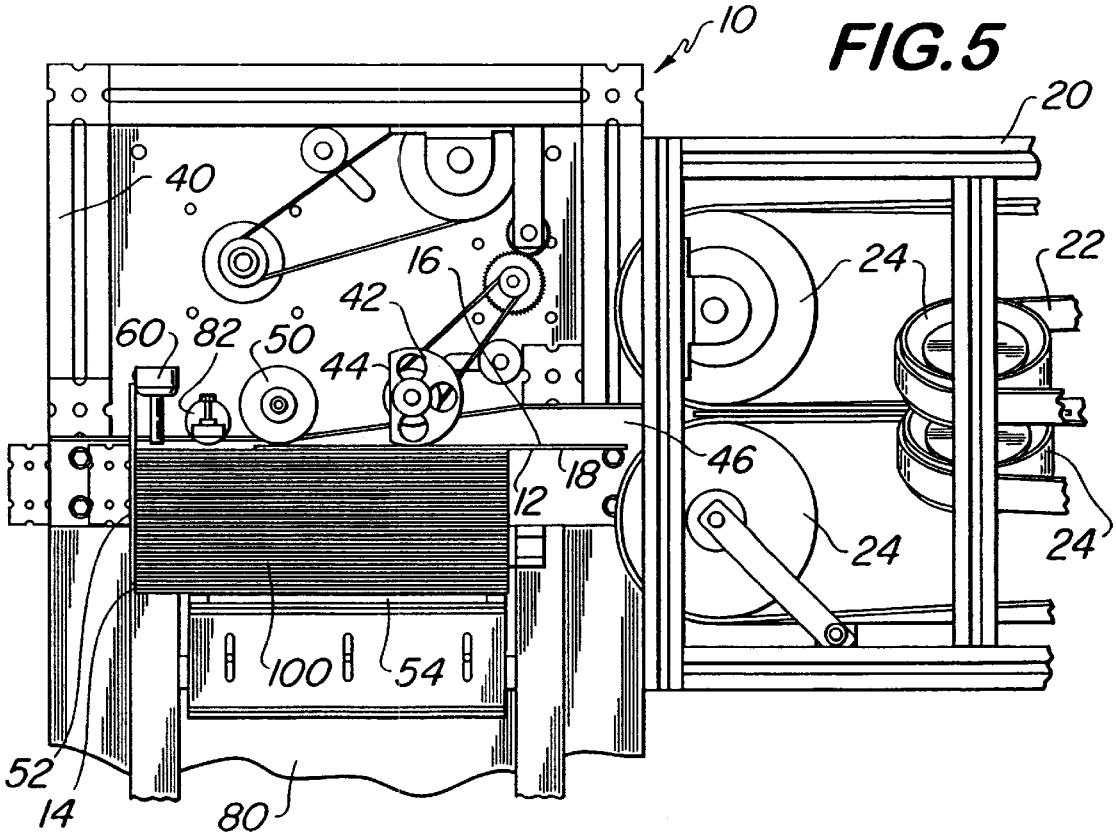
FIG. 5 is a partial top view of the on-edge stacking apparatus of FIG. 1. depicted with an envelope stack and a single envelope entering the envelope stack showing the segmented roller during rotation.
Figure 6:
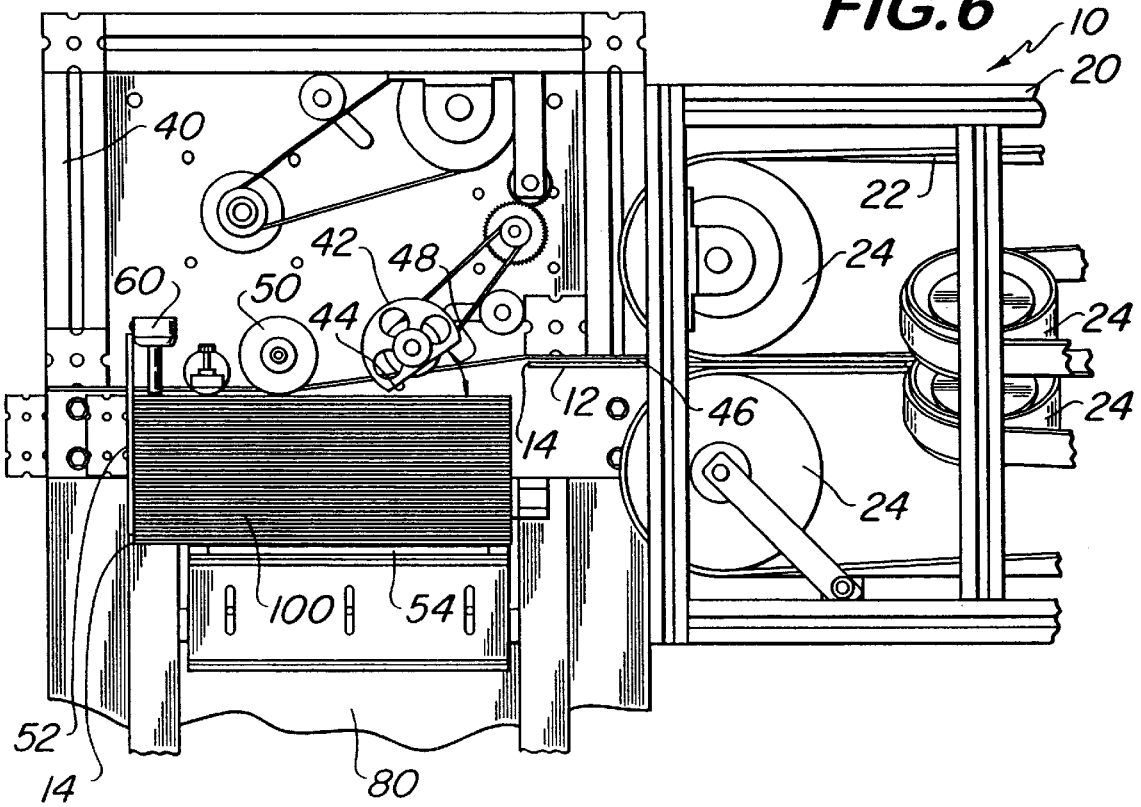
FIG. 6 is a partial top view of the on-edge stacking apparatus of FIG. 1. depicted with an envelope stack with the segmented roller in its home position awaiting an envelope.

As can best be seen in FIGS. 3–8, once the envelope 12 is on edge, the envelope is transferred through the discharge magazine 40 onto a conveyor 80, usually about 6 to 8 feet long, and inserted into the rear of an envelope stack 100. The discharge magazine 40 takes a series of on-edge envelopes 12 and aligns them to be stacked. The discharge magazine 40 utilizes a novel segmented roller 42 in which a segment is removed such that the generally cylindrical segmented roller 42 has a flat, planar surface 44 that is perpendicular to the longitudinal axis of the segmented roller 42. As can be seen in FIG. 3 where a first envelope 12A is entering the discharge magazine 40, as the envelope 12A enters the article inlet 46 of the discharge magazine 40, the segmented roller 42, stationary in its home position, maintains a gap 48 for the first envelope 12A to enter. The flat, planar surface 44 of the segmented roller 42 acts as a guide to the incoming envelope 12A. If the flat, planar surface 44 of the segmented roller 42 was not there, the incoming envelope 12 would crash into the roller. As soon as the first incoming envelope 12A (and each succeeding incoming envelope 12), approaches the segmented roller 42 and enters the gap 48, the segmented roller 42 indexes 360 degrees and then stops to assist in driving the first envelope 12A to start the horizontal stack 100 and then stacks each succeeding envelope 12 behind the first envelope 12A into the stack 100. As can be seen in FIG. 4, the stack 100 is formed and the gap 48 formed by the flat, planar surface 44 of the segmented roller 42 on each rotation continues to be maintained for each successive envelope 12. FIG. 5 depicts an envelope 12 in the process of being moved by the segmented roller 42 against a register wall 52, as described below. Here, the segmented roller 42 has rotated approximately 135 degrees. FIG. 6 shows the segmented roller 42 back in its home position awaiting the next envelope to enter.

Preferably, as depicted in FIG. 1, the segmented roller 42 is formed in three sections. This decreases the mass of the roller to allow for easier incremental driving of the roller 42.

In addition to the segmented roller, there is optionally a second continuously rotating roller 50 which is an assist drive roller that runs continuously and assures that the incoming envelope is driven to an article edge receiving means, preferably in the form of a register wall 52, where the front perimeter edges 14 of envelopes 12 are aligned for stacking.

As indicated above, after rotating the 360 degrees, the segmented roller 42 stops and holds in its home position, awaiting the next envelope 12. As can be seen particularly clearly in FIG. 1, a face 16 of the first envelope 12A entering to form the stack 100 mates with an article face receiving means 54 in the form of a movable upright support member provided to hold the first envelope 12A and the succeeding envelopes 12 upright in an on-edge position. As each successive envelope 12 enters the stack 100 and the stack 100 increases in size, the article face receiving means 54 may be incrementally moved along a conveyor 80, either manually or as described below, to allow additional room for a large stack 100 or envelopes 12.

Optionally, mounted on the discharge magazine 40 is a conveyor sensor, preferably a pressure sensitive stack switch 82 which is used to sense the pressure of the horizontal envelope stack 100 against the article face receiving means 54. When pressure due to a large number of envelopes in the stack 100 causes the switch to trip, a horizontal conveyor belt on the conveyor 80 indexes to relieve this pressure, thereby making room for the next envelope or series of envelopes 12 to enter.

Figure 7:
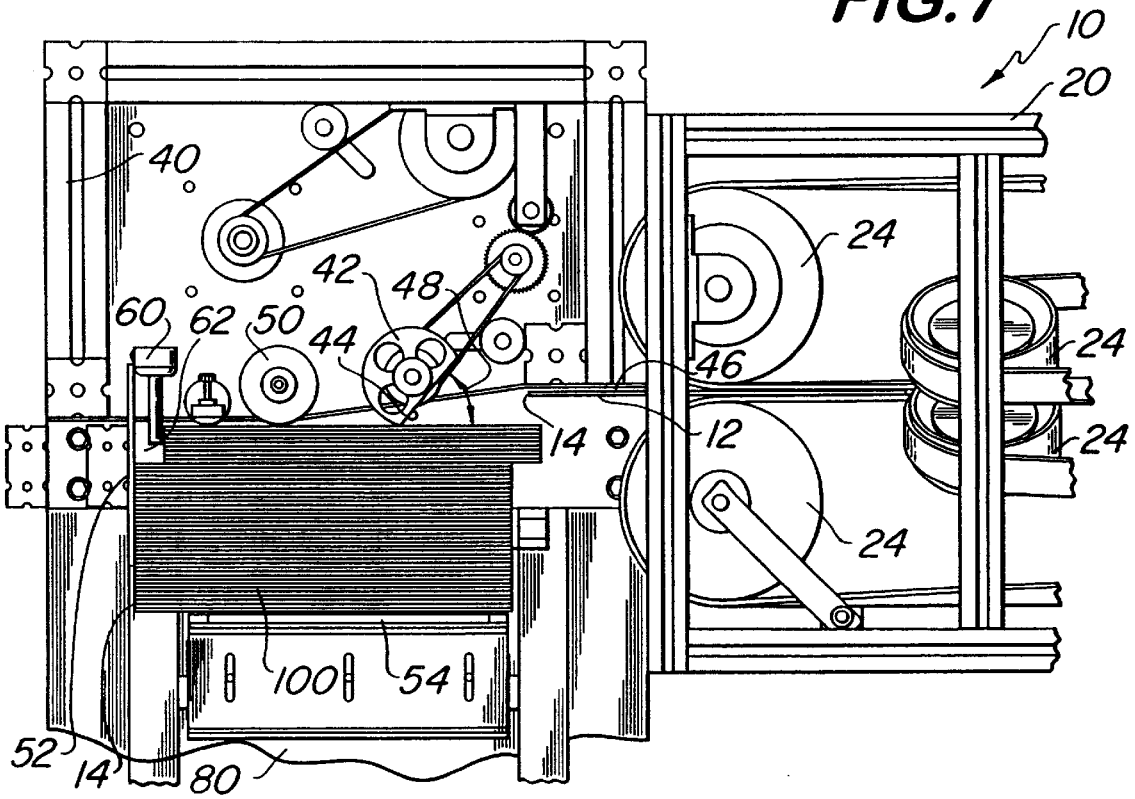
FIG. 7 is a partial top view of the on-edge stacking apparatus of FIG. 1 depicted with an envelope stack and showing an envelope offset device in an extended position such that the envelope stack is offset to indicate a zip code break.
Figure 8:
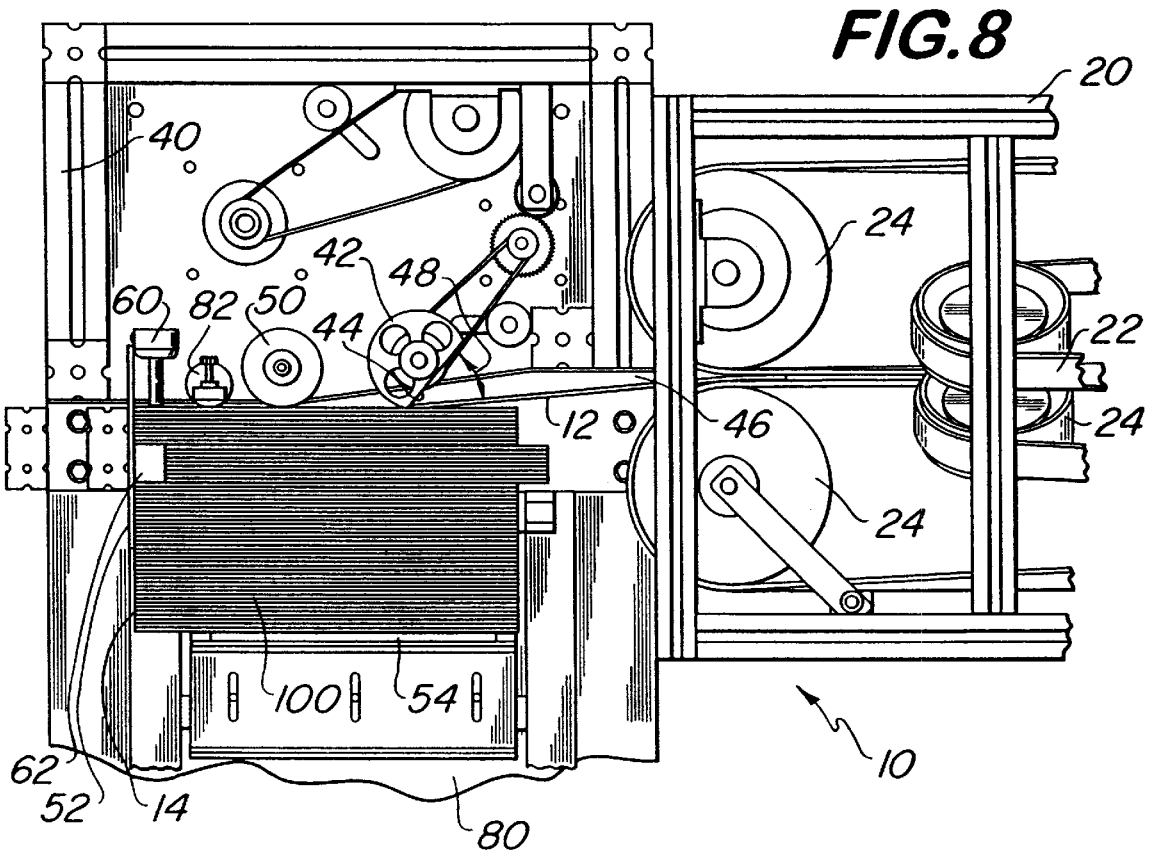
FIG. 8 is a partial top view of the on-edge stacking apparatus of FIG. 1 depicted with an envelope stack and showing an envelope offset device in a retracted position, subsequent to the offset device being in an extended position, such that an additional zip code break is shown

As best can be seen in FIGS. 7 and 8, another optional feature of the on-edge stacking conveyor is the ability to offset the registered edge of the horizontal envelope stack 100 so as to easily identify the zip code change or count to the offloading operator. This is accomplished by a printing (zip code, bar code, optical mark, etc.) being read onto the envelope 12 by an electronic reading device as the envelope 12 enters the on-edge stacking apparatus. This data is then used to index an article stack offset means 60 such as a cylinder having an electronically controlled shaft that moves in a longitudinal direction, to cause the front perimeter edge 14 of the envelope stack 100 to create an offset 62 from the envelopes 100 previously received in the stack. When a new zip code break is read, the offset means 60 retracts, causing new envelopes to move to the original article edge receiving means 52. The result is an indexed stack with zip code breaks easily identified, thereby saving significant time unloading the envelopes 12 into mail trays.

Without further elaboration, the foregoing will so fully illustrate our invention that others may, by applying current or future knowledge, readily adopt the same for use under various conditions of service.

We claim:

1. A stacking apparatus for stacking a plurality of flat articles on edge, each article having a front perimeter edge and two faces, said stacking apparatus adapted to receive each of said plurality of flat articles as each article enters said stacking apparatus moving in a direction generally parallel to said faces of each article, said stacking apparatus comprising:

(a) a discharge magazine for sequentially receiving and stacking said flat articles face-to-face in an on-edge stack, comprising:

i) an article inlet, ii) an article edge receiving means, wherein each front perimeter edge contacts said article edge receiving means to align each front perimeter edge of each article as said articles enter said stack; and iii) an article face receiving means wherein a face of one of said flat articles abuts said article face receiving means;

(b) a segmented roller for receiving and aligning said flat articles for insertion into said on-edge stack, comprising a rotatable segmented cylinder having a longitudinal central axis, said segmented cylinder disposed adjacent said article inlet and having at least one planar surface thereon substantially parallel to the longitudinal central axis of said segmented cylinder, said planar surface in said segmented cylinder being adapted to open a gap between a prior article and said segmented roller, said planar surface receiving a single article and so that the segmented roller may be incrementally rotated to drive said article against said article edge receiving means, said segmented roller continuing to rotate until one of said at least one planar surfaces is rotated into position to open an additional gap between said stack and said segmented roller adapted to receive the next article entering the article inlet; and (c) a belt turn-up mechanism that reorients each article ninety degrees prior to entry into said discharge magazine, wherein said belt turn-up mechanism uses a single belt.

2. A stacking apparatus for stacking a plurality of flat articles on edge, each article having a front perimeter edge and two faces, said stacking apparatus adapted to receive each of said plurality of flat articles as each article enters said stacking apparatus moving in a direction generally parallel to said faces of each article, said stacking apparatus comprising:

(a) a discharge magazine for sequentially receiving and stacking said flat articles face-to-face in an on-edge stack, comprising:

i) an article inlet, ii) an article edge receiving means, wherein each front perimeter edge contacts said article edge receiving means to align each front perimeter edge of each article as said articles enter said stack; and iii) an article face receiving means wherein a face of one of said flat articles abuts said article face receiving means;

(b) a segmented roller for receiving and aligning said flat articles for insertion into said on-edge stack, comprising a rotatable segmented cylinder having a longitudinal central axis, said segmented cylinder disposed adjacent said article inlet and having at least one planar surface thereon substantially parallel to the longitudinal central axis of said segmented cylinder, said planar surface in said segmented cylinder being adapted to open a gap between a prior article and said segmented roller, said planar surface receiving a single article and so that the segmented roller may be incrementally rotated to drive said article against said article edge receiving means, said segmented roller continuing to rotate until one of said at least one planar surfaces is rotated into position to open an additional gap between said stack and said segmented roller adapted to receive the next article entering the article inlet; and (c) a belt turn-up mechanism that reorients each article ninety degrees prior to entry into said discharge magazine, wherein said belt turn-up mechanism uses a single belt, said belt turn-up mechanism adapted to turn said articles either clockwise or counterclockwise.

3. A stacking apparatus for stacking a plurality of flat articles on edge, each article having a front perimeter edge and two faces, said stacking apparatus adapted to receive each of said plurality of flat articles as each article enters said stacking apparatus moving in a direction generally parallel to said faces of each article, said stacking apparatus comprising:

(a) a discharge magazine for sequentially receiving and stacking said flat articles face-to-face in an on-edge stack, comprising:

i) an article inlet, ii) an article edge receiving means, wherein each front perimeter edge contacts said article edge receiving means to align each front perimeter edge of each article as said articles enter said stack; and iii) an article face receiving means wherein a face of one of said flat articles abuts said article face receiving means;

(b) a segmented roller for receiving and aligning said flat articles for insertion into said on-edge stack, comprising a rotatable segmented cylinder having a longitudinal central axis, said segmented cylinder disposed adjacent said article inlet and having a single planar surface thereon substantially parallel to the longitudinal central axis and is adapted to rotate 360 degrees for each article received, said planar surface in said segmented cylinder being adapted to open a gap between a prior article and said segmented roller, said planar surface receiving a single article and so that the segmented roller may be incrementally rotated to drive said article against said article edge receiving means, said segmented roller continuing to rotate until one of said at least one planar surfaces is rotated into position to open an additional gap between said stack and said segmented roller adapted to receive the next article entering the article inlet, said segmented roller adapted to be stationary during the receiving of each article and subsequently rotates 360 degrees to drive that article against the article receiving means; and (c) a belt turn-up mechanism that reorients each article ninety degrees prior to entry into said discharge magazine, wherein said belt turn-up mechanism uses a single belt.

4. A stacking apparatus for stacking a plurality of flat articles on edge, each article having a front perimeter edge and two faces, said stacking apparatus adapted to receive each of said plurality of flat articles as each article enters said stacking apparatus moving in a direction generally parallel to said faces of each article, said stacking apparatus comprising:

(a) a discharge magazine for sequentially receiving and stacking said flat articles face-to-face in an on-edge stack, comprising:

i) an article inlet, ii) an article edge receiving means, wherein each front perimeter edge contacts said article edge receiving means to align each front perimeter edge of each article as said articles enter said stack; and iii) an article face receiving means wherein a face of one of said flat articles abuts said article face receiving means;

(b) a segmented roller for receiving and aligning said flat articles for insertion into said on-edge stack, comprising a rotatable segmented cylinder having a longitudinal central axis, said segmented cylinder disposed adjacent said article inlet and having a single planar surface thereon substantially parallel to the longitudinal central axis and is adapted to rotate 360 degrees for each article received, said planar surface in said segmented cylinder being adapted to open a gap between a prior article and said segmented roller, said planar surface receiving a single article and so that the segmented roller may be incrementally rotated to drive said article against said article edge receiving means, said segmented roller continuing to rotate until one of said at least one planar surfaces is rotated into position to open an additional gap between said stack and said segmented roller adapted to receive the next article entering the article inlet, said segmented roller adapted to be stationary during the receiving of each article and subsequently rotates 360 degrees to drive that article against the article receiving means; and (c) a belt turn-up mechanism that reorients each article ninety degrees prior to entry into said discharge magazine, wherein said belt turn-up mechanism uses a single belt, said belt turn-up mechanism adapted to turn said articles either clockwise or counterclockwise.

* * * * *